United States Patent [19]

Little

[11] Patent Number: 4,753,023

[45] Date of Patent: Jun. 28, 1988

[54] POWER TRANSMISSION THROUGH A SHAFT SUBJECT TO ORBITING

[75] Inventor: Charles D. Little, Graceland Park, Md.

[73] Assignee: Ellicott Machine Corporation, Baltimore, Md.

[21] Appl. No.: 8,733

[22] Filed: Jan. 30, 1987

[51] Int. Cl.[4] ..... E02F 3/92

[52] U.S. Cl. ..... 37/64; 248/638; 384/222; 440/57

[58] Field of Search ..... 440/52, 57, 83, 111, 440/112; 37/67, 65, 64; 248/638; 384/221, 222

[56] References Cited

U.S. PATENT DOCUMENTS

| | | | |
|---|---|---|---|
| 484,763 | 10/1892 | Bowers | 37/67 |
| 1,750,016 | 3/1930 | Meyer | 248/638 X |
| 2,166,259 | 7/1939 | Meyer | 384/222 |
| 2,477,221 | 7/1949 | Von Bolhar | 384/222 |
| 2,903,209 | 9/1959 | Strub | 248/638 X |
| 3,177,841 | 4/1965 | Galuska | 440/112 |
| 3,452,704 | 7/1969 | Watkins | 440/57 |
| 3,885,330 | 5/1975 | Araoka | 37/64 X |

FOREIGN PATENT DOCUMENTS

| | | | |
|---|---|---|---|
| 819277 | 4/1981 | U.S.S.R. | 37/67 |

*Primary Examiner*—Clifford D. Crowder
*Attorney, Agent, or Firm*—Scrivener and Clarke

[57] ABSTRACT

A shaft subject to orbiting motion as it is driven in rotation is directly connected to the prime mover driving the shaft so that the prime mover follows the orbiting motion of the shaft. The housing associated with the prime mover is connected to a fixed structure through a universal coupling, which may be a gimbal, capable of preventing the housing from rotating relative to the fixed structure while permitting it to follow the orbiting motion of the shaft.

10 Claims, 2 Drawing Sheets

POWER TRANSMISSION THROUGH A SHAFT SUBJECT TO ORBITING

This invention relates to means for transmitting power from a prime mover through a shaft to a working member such as a dredge cutter head and more particularly to a power transmission of the foregoing nature wherein the shaft while being rotated, is subject to orbiting motion.

There are a number of fields where a working member such as a dredge cutter head, is driven at the end of a shaft which may be supported on some kind of a deformable bearing, for example, a water lubricated, so-called cutless bearing wherein an elastomeric sleeve or liner is disposed between the shaft end and a rigid sleeve rigidly fixed to a support member. Because the elastomeric sleeve yields, particularly when the working member is subjected to side loading, as is the case of a dredge cutter head swinging from side to side across the bottom, the end of the shaft while it is rotating also can have imparted thereto an orbiting motion due to the yielding nature of the elastomeric sleeve. Heretofore it has been the practice to isolate this orbiting motion from a rigidly mounted prime mover by means of some kinds of flexible coupling between the output shaft of the prime mover and the drive shaft carrying the working member. The problem with flexible couplings is that they become worn very quickly and this wear is accelerated the more the deformable bearing becomes extruded or worn during use whereby the orbiting motion is increased. Frequent replacement of a flexible coupling is not only expensive but it can cause a substantial economic loss during the period the apparatus is inoperative while the coupling is being replaced.

The broad object of the present invention is to eliminate the problems caused by flexible couplings by simply eliminating them entirely and instead of mounting the prime mover on a fixed support, which may be the ladder of a dredge, mounting the prime mover on the end of the shaft itself so that the prime mover freely follows any orbiting movement of the shaft end.

More particularly it is an object of the invention to mount the housing of the prime mover to a rigid support through a universal coupling such as a gimbal, which, while preventing the housing from rotating, permits it and thus the entire prime mover to freely follow any orbiting movement of the shaft end to which the prime mover is connected.

Figure 1:
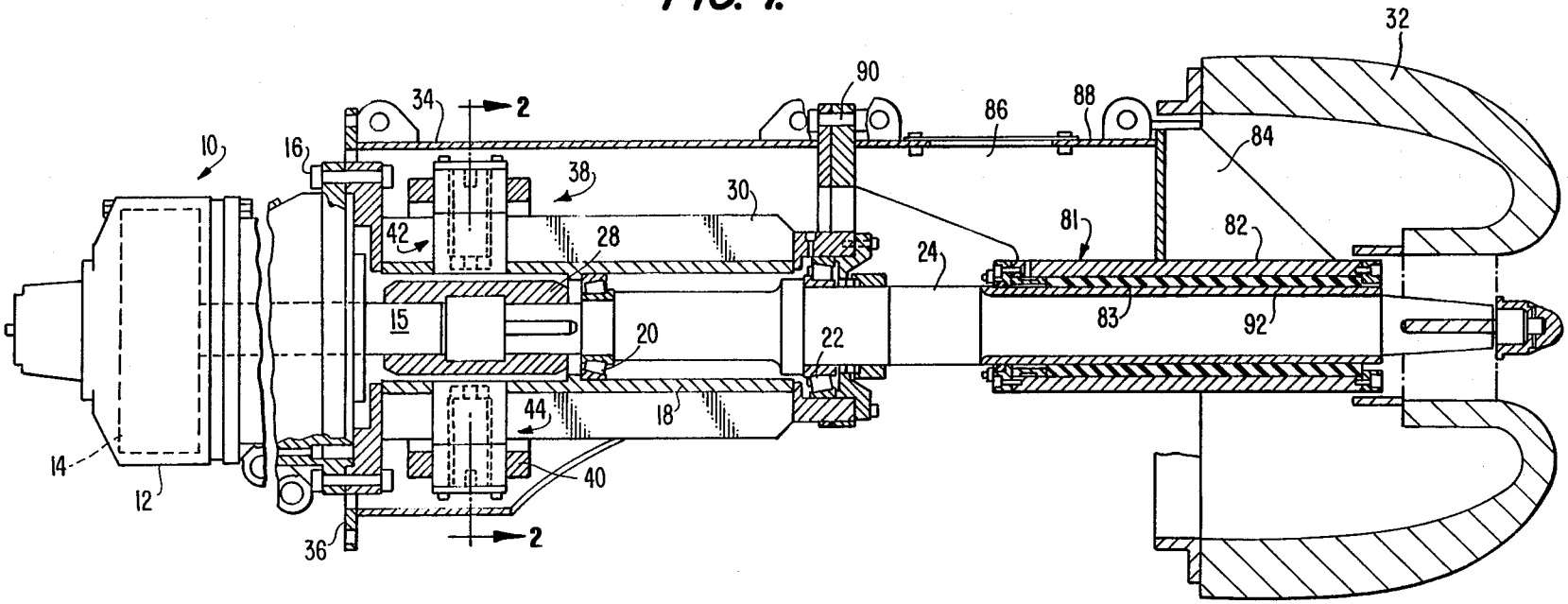
Figure 2:
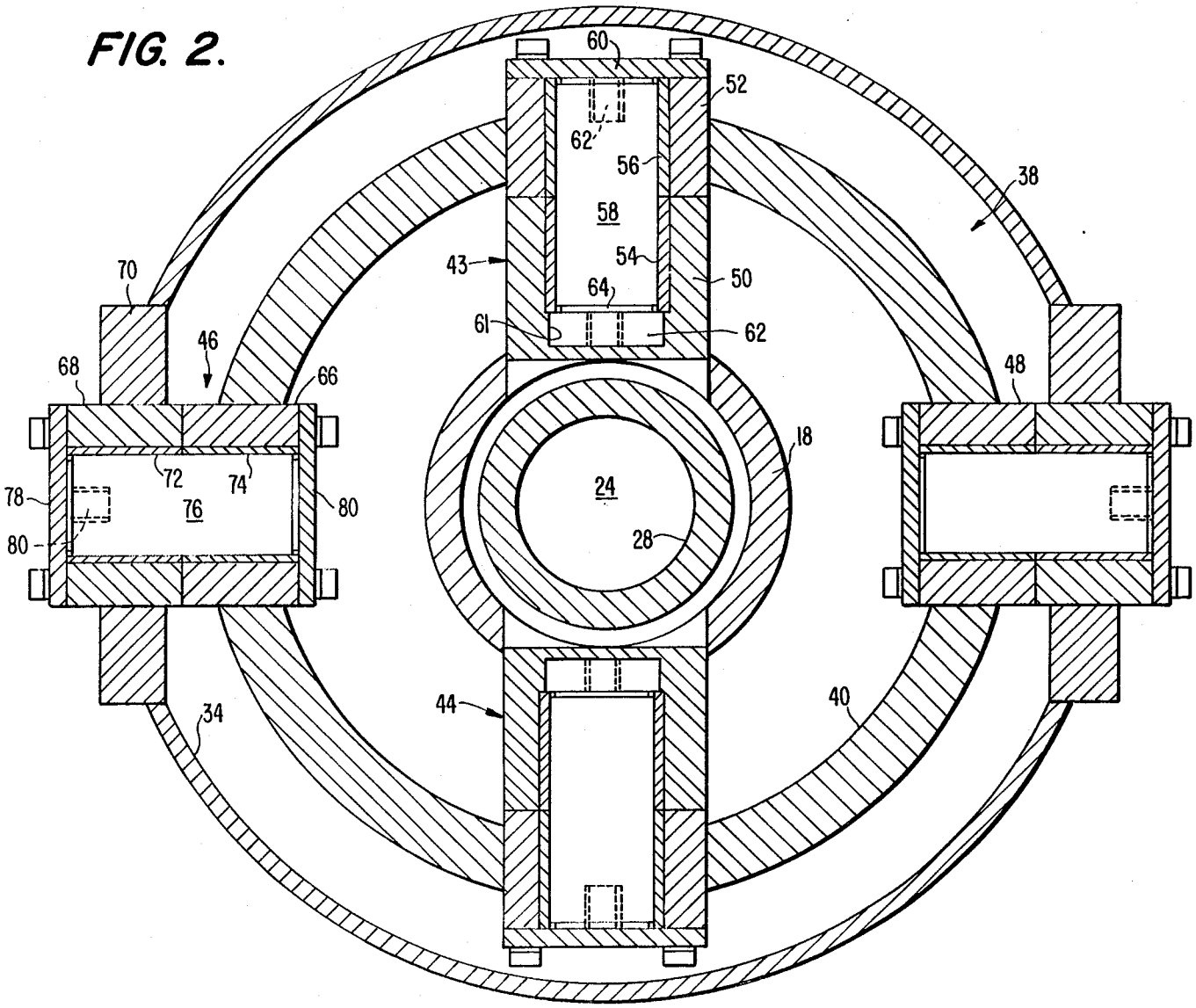

Other objects and their attendant advantages will become apparent as the fol1-owing detailed description is read in conjunction with the accompanying drawings wherein:

FIG. 1 is a vertical cross section view, partly in elevation showing the invention as used in connection with driving a cutter head for a dredge; and FIG. 2 is an enlarged vertical cross sectional view taken substantially on the line 2—2 of FIG. 1.

Though the invention will be described in connection with its application to a dredge, it will be observed, as the description proceeds, that the invention has wider application as, for example, to ship propellers.

With reference to FIG. 1, the numeral 10 designates a prime mover which includes a housing 12 and rotary drive means 14 within the housing. The drive means 14 could be an electric, hydraulic or any other suitably driven rotor having an output shaft 15. Rigidly connected to the housing 12 by bolts 16 and forming an extension thereof is a housing part 18. Journaled in the latter on bearings 20, 22 is one end of a drive shaft 24 which is rigidly connected to the output shaft 15 of the prime mover by means of a conventional sleeve coupling 28. The housing part 18, may, if necessary, be provided with strengthening fins 30. The output shaft 15 of the prime mover and the drive shaft 24 may be considered as a unitary shaft rigidly and drivingly connected to the train between the drive means 14 and the ridigly connected drive means 14 which may include reducer means in the drive shafts 15, 24.

A working member, which may be the cutter head 32 of a dredge, as shown, is fixed in a conventional manner to the shaft 24 proximate that end opposite the end connected to the prime mover. Extending in spaced relation over at least a portion of the housing part 18 is a fixed rigid member 34 which, in the case of a dredge, may define the outer end section of a dredge ladder to which the member 34 would be fixed by bolts (not shown) through the apertured flange 36.

In accordance with the invention, a universal coupling, broadly designated by the numeral 38 and described in detail hereafter, connects the prime mover housing 12, 18 and the rigid member 34, the universal coupling including means for positively preventing the housing 12, 18 from rotating relative to the rigid member 34 and also including means permitting the housing to follow freely orbiting motion imparted thereto by the shaft 24 during operation thereof by the drive means.

The universal coupling 38, as best seen in FIG. 2, comprises a gimbal which includes a gimbal ring 40 encircling the housing part 18 in the space between it and the rigid member 34. A first pair of diametrically opposed pivots 42, 44 connect the housing part 18 and the gimbal ring 40, the axes of pivots 42, 44 being normal to the axis of rotation of the shaft 24. A second pair of diametrically opposed pivots 46, 48 having their pivot axes at right angles to the first pair of pivots connect the gimbal ring 40 and the rigid member 34.

As is clear in FIG. 2, the gimbal ring 40 surrounds, without intersecting, the axis of rotation of the shaft 24.

The pivots 42, 44 are identical and each includes a socket 50 welded to the housing part 18 and a sleeve 52, co-axially welded to the ring 40. Bushings 54, 56 are received within the sleeve and socket, and received within the bushings 54, 56 is a pin member 58. A bolted cover 60 retains the bushings and pin member in place. The pin member 58 is provided with a threaded blind bore 62 by which it may be removed when engaged by a suitable tool. The socket 50 has a reduced diameter recess 61 at its inner end to receive an element 62 having a threaded bore 64 with which a tool can be engaged to lift the element and by it the bushings 54, 56, clear of the socket 50 and sleeve 52.

The pivot 46, are also identical to each other and each includes a first sleeve 66 welded to the gimbal ring 40 and a second co-axial sleeve 68 welded to an insert 70 which in turn is welded to the rigid member 34. Bushings 72, 74 are received within the sleeves 66, 68 and received within the bushings is a unitary pin 76. A bolted cover 78 retains the pin member and bushings within the sleeves. A threaded bore 80 in the pin member 76, when engaged by a suitable tool, facilitates removal of the pin member.

It will be seen that the universal coupling in the form of the gimbal just described provides the means for positively preventing the prime mover housing 12, 18 from rotating relative to the rigid member 34 while it also permits the housing and hence the entire prime mover to follow freely any orbiting motion imparted thereto by the shaft 24 during operating thereof by the drive means 14 of the prime mover.

As so far described, the invention is applicable to a working member which is more or less cantilevered on the end of the shaft 24 and the invention is susceptible of such use. Because many working members are subject to heavy side loading, as for example, are dredge cutter heads, there must be bearing support for the end of the shaft adjacent the cutter head. Bearings, such as the bearing 81, commonly in use for dredge shafts are water lubricated or so-called cutless bearings comprising an outer rigid sleeve which surrounds the shaft end with clearance and a bearing liner comprising an inner elastomeric sleeve 83 between the rigid sleeve and the shaft end. Means such as the gusset plates 84, 86 rigidly fix the outer sleeve 82 to a rigid support 88 which may be bolted at 90 to the rigid member 34, the rigid support 88 constituting an outer end part of a dredge ladder. Interposed between the elastomeric sleeve 83 and the shaft end is an inner rigid sleeve 92.

From what has been shown and described, it can be seen that the elastomeric sleeve is subject to deformation during use by side loading, by wear or by the natural forces of a massive rotating working member and will permit the shaft to have orbiting motion while it rotates. The described elastomeric sleeve type liner is representative of any similarly disposed bearing having a rigid outer sleeve and a deformable bearing liner between the sleeve and shaft and which, due to wear or otherwise, during use permits a shaft to orbit while being rotatably driven. Prior to the present invention, this orbiting motion was catered to by flexible couplings between a rigidly mounted prime mover and the shaft, causing the problems as described above. Those problems have been largely solved by the present invention and though the invention is particularly useful in the field of cutter head dredging, the invention is not limited to such use but may be used wherever a drive shaft is subject to orbiting motion during rotation thereof, as for example, the driving of ship propellers. Thus the invention is clearly susceptible of modification and changes without, however, departing from the scope and spirit of the appended claims.

I claim:

1. A power transmission comprising a prime mover including a housing and rotary drive means within said housing, a drive shaft having one end journaled in said housing and drivingly connected with said drive means, a working member co-axially fixed to said shaft proximate its opposite end, a fixed rigid member extending in spaced relation over at least a portion of said housing, and a universal coupling connecting said housing and said rigid member, said universal coupling including means for positively preventing said housing from rotating relative to said rigid member, and also including means permitting said housing and hence said prime mover to follow freely orbiting motion imparted thereto by said shaft during operation thereof by said drive means, said universal coupling comprising a gimbal including a gimbal ring encircling said housing in the space between it and said rigid member, a first pair of diametrically opposed pivots connecting said housing and said gimbal ring, the axes of said pivots being normal to the axis of rotation of said shaft, and a second pair of diametrically opposed pivots having their pivot axes at right angles to the first pair of pivots, said second pair of pivots connecting said gimbal ring and said rigid member.

2. The power transmission of claim 1, wherein the working member is the digging head of a dredge.

3. The transmission of claim 1, including a bearing for the end of said shaft proximate to said working member comprising an outer rigid sleeve surrounding said end of said shaft with clearance, a deformable bearing liner between said outer rigid sleeve and said end of said shaft, and means fixing said outer rigid sleeve to a rigid support, said bearing liner being deformable during use to permit orbiting motion of said shaft.

4. The transmission of claim 3, wherein said last mentioned rigid support is said rigid member.

5. The transmission of claim 3, wherein said working member is the digging head for a dredge and said bearing is water lubricated.

6. The transmission of claim 3, including in addition an inner rigid sleeve interposed between said shaft end and said liner.

7. The transmission of claim 3, wherein said deformable bearing liner is an elastomeric sleeve.

8. The transmission of claim 1, wherein said prime mover is an hydraulic motor.

9. The power transmission of claim 1, wherein the plane of said gimbal ring is substantially normal to the axis of rotation of said shaft.

10. The power transission of claim 1, wherein said gimbal ring surrounds, without intersecting, the axis of rotation of said shaft.

* * * * *